US006487738B1

(12) United States Patent
Graebe

(10) Patent No.: US 6,487,738 B1
(45) Date of Patent: Dec. 3, 2002

(54) CONSTANT RESTORING FORCE SUPPORT SURFACE

(75) Inventor: Robert H. Graebe, Belleville, IL (US)

(73) Assignee: Offspring, LLC, Belleville, IL (US)

( * ) Notice: Subject to any disclaimer, the term of this patent is extended or adjusted under 35 U.S.C. 154(b) by 0 days.

(21) Appl. No.: 09/528,594

(22) Filed: Mar. 20, 2000

(51) Int. Cl.[7] ..... A47C 23/05

(52) U.S. Cl. ..... 5/719; 5/258; 5/716; 5/720; 267/82; 267/94

(58) Field of Search ..... 5/258, 253, 709, 5/716, 719, 720, 655.7, 655.8; 267/82, 94, 124, 128, 129

(56) References Cited

U.S. PATENT DOCUMENTS

| | | | | | |
|---|---|---|---|---|---|
| 106,069 | A | * | 8/1870 | Lord | 5/258 |
| 958,356 | A | | 5/1910 | Bode | |
| 986,183 | A | * | 3/1911 | Leahan | 5/258 |
| 1,169,863 | A | | 2/1916 | Peycke | |
| 1,475,010 | A | * | 11/1923 | Garbutt | 5/258 |
| 2,112,702 | A | | 3/1938 | Loibl | |
| 2,184,396 | A | | 12/1939 | Mudge | |
| 2,532,425 | A | | 12/1950 | Schenker | |
| 2,543,785 | A | | 3/1951 | Lermont | |
| 2,558,288 | A | | 6/1951 | Backus | |
| 2,609,192 | A | | 9/1952 | Lermont | |
| 2,609,193 | A | | 9/1952 | Foster | |
| 2,630,585 | A | | 3/1953 | Reese | |
| 2,663,360 | A | | 12/1953 | Ory | |
| 2,742,957 | A | | 4/1956 | Young | |
| 3,031,690 | A | | 5/1962 | Ramsay | |
| 3,340,548 | A | | 9/1967 | Janapol | |
| 3,467,973 | A | | 9/1969 | Minnick | |
| 3,475,865 | A | | 11/1969 | Arnes | |
| 3,608,107 | A | | 9/1971 | Kentor et al. | |
| 3,623,171 | A | | 11/1971 | Arkin | |
| 3,633,228 | A | | 1/1972 | Zyman | |
| 3,992,751 | A | | 11/1976 | Foster et al. | |
| 3,999,234 | A | | 12/1976 | Regan | |
| 4,128,120 | A | | 12/1978 | Frey | |
| 4,190,914 | A | * | 3/1980 | Diallo | 5/719 |
| 4,222,137 | A | | 9/1980 | Usami | |
| 4,262,888 | A | | 4/1981 | Jansen et al. | |
| 4,673,605 | A | | 6/1987 | Sias et al. | |
| 4,757,642 | A | | 7/1988 | Hahn | |
| 4,869,704 | A | | 9/1989 | Fisher | |
| 4,935,987 | A | | 6/1990 | Sterner, Jr. | |
| 4,965,898 | A | | 10/1990 | So | |
| 5,332,202 | A | | 7/1994 | Wagner et al. | |
| 5,426,799 | A | * | 6/1995 | Ottiger et al. | 5/719 |
| 5,558,314 | A | * | 9/1996 | Weinstein | 5/719 |

FOREIGN PATENT DOCUMENTS

| | | | | | |
|---|---|---|---|---|---|
| DK | 000050296 | A | * | 6/1935 | 5/716 |
| NO | 89890 | A | * | 6/1957 | 5/258 |

* cited by examiner

*Primary Examiner*—Michael F. Trettel
(74) *Attorney, Agent, or Firm*—Polster, Lieder, Woodruff & Lucchesi L.C.

(57) ABSTRACT

An all mechanical support surface that tracks the flotation properties of a true fluid and utilizes a series of constant restoring force springs connecting reciprocating pistons which have supporting surfaces with multiple degrees of freedom to define a user supporting surface that assumes the shape of the user and minimizes the force differential on different areas of the user's skin.

38 Claims, 7 Drawing Sheets

CONSTANT RESTORING FORCE SUPPORT SURFACE

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

This invention relates to an all mechanical support surface which synthesizes the flotation properties of a true fluid. Specifically, this invention relates to a non-pneumatic support surface that has the capability of assuming the shape of the person lying or sitting on it to minimize the force differential on different areas of the skin of such person. This characteristic of the support surface is particularly critical to facilitate blood flow particularly where the user is handicapped, bedridden or disabled.

The present invention provides the flotation properties of a true fluid as follows: (1) Low surface tension caused by providing a highly displaceable support surface. (2) Buoyancy caused by providing suspension forces that have a constant restoring force which is independent of immersion depth. (3) Wetted surface equivalence is provided by shape compliance, where the application of suspension forces at the tissue-surface interface has multiple degrees of freedom to align with and envelope the shape of the person at the contacted surface areas. (4) Low friction to maintain the constant restoring force properties of the moving elements (piston) throughout the immersion depth of the device. (5) Low friction at the tissue interface, using dry lubricant techniques, e.g., teflon-coated fabrics, to permit some sliding as the shape fitting is occurring. (6) Viscosity control with dash-pot techniques, to maintain the feel of a true fluid and to provide slow changes when a floating body moves. Motion control is of great importance when serving the safety needs of the disabled person. High viscosity, however, does not provide positional stability to the supported object. Stability is defined as: when an object moves after receiving a disturbing force it will return to its initial position after the disturbing force is removed.

A support surface having the foregoing characteristics is especially important when used by persons prone to decubitus ulcers which occur when deformation occurs on areas of the body inducing interference with the flow of blood at the contacted site.

One solution to this problem is the use of cellular air filled cushions and the inventor of this application has numerous patents which are directed to air inflatable cushions which have upstanding soft flexible cells, many of which have finned sides, known as ROHO DRY FLOTATION cushions and mattresses. Among these are patent numbers 3605145, 3870450, 4005236, and 4541136, all issued to Robert H. Graebe. These cushions are made from neoprene rubber or plastic films to create a highly displaceable high resolution surface. The cells also are interconnected pneumatically in what are known as "feedback pathways." The cells in a particular cushion may all be interconnected or sets of said cells can be isolated from other sets in the same cushion with the cells in each set interconnected to allow for positioning of the user in a desired stable position on the cushion.

Among patents with such configurations are 5052068, 5163196, and 5461741. These cellular air-filled cushions can be constructed to fit on the mechanical piston of this invention.

In the ROHO cushions, each air cell acts as a piston to develop constant restoring forces as a function of its internal air pressure and because of the feedback pathways they all have the same restoring force to buoy up the person being supported. The use of feedback pathways causes a catastrophic failure mode, when an aircell develops a leak, and the support surface goes flat. By design each air cell has the same effective piston size to assure uniformity of forces across the support surface. Having different sized pistons and therefore non-uniform forces produces a change in wetted surface area and shape compliance but the total summation of all the suspension forces contributing to buoyancy still must equal the weight of the person being supported. Uniform cell (piston) size and/or cell shape facilitates production and inventory issues more than suspension performance results. These air filled cushions or mattresses with slow air flow feedback paths create a high viscosity effect and permit selecting immersion depth for each individual by adjusting the internal working pressure of the cushion.

The soft flexible cells provide multiple (6) degrees of freedom at the tissue interface by deforming to align with the contours of the supported object to enhance its wetting equivalence to a true fluid. The multiple fin design is employed to create gluing surfaces between individual cells and may have some effect on suspension performance which cannot be measured when compared to a more simple non-finned cell.

It is a principal object of the present invention is to provide a mechanical device which emulates the effect of the aforementioned ROHO air cell cushions and mattresses. Another object is to provide a cushion and mattress constructed from rigid materials which still will provide the flotation properties of a true fluid. Still another object is to provide a cushion and mattress which has a series of reciprocal piston heads which are controlled by constant restoring force springs whereby the force exerted by the piston head is constant regardless of its travel within its movement limits.

A further object of this invention is to provide a cellular cushion and mattress construction in which the cells (pistons) are mechanical and are easily replaceable to adjust the restoring force of the cells to accommodate users of various body weights and contact areas. A further object is to provide a means to dampen piston movement rates to create viscosity control. A further object is to provide a support surface that does not have a catastrophic failure mode.

Still another object is to provide a mechanical cushioned mattress using reciprocal piston rods operated by constant restoring force springs which can be located inside or outside the piston to change the surface area and density of the pistons. Another object is to provide mechanical piston operated cushions and mattress in which the end of the piston rod has multiple degrees of freedom. These and other objects and advantages will become apparent hereinafter.

The present invention comprises mechanically operated mattresses and cushions which are controlled by constant restoring force springs and the arrangements and combination of parts simulate the flotation properties of a true fluid.

BRIEF DESCRIPTION OF THE SEVERAL VIEWS OF THE DRAWINGS

In the accompanying drawings which form part of the specification and wherein like numerals and letters refer to like parts wherever they occur.

Figure 1:
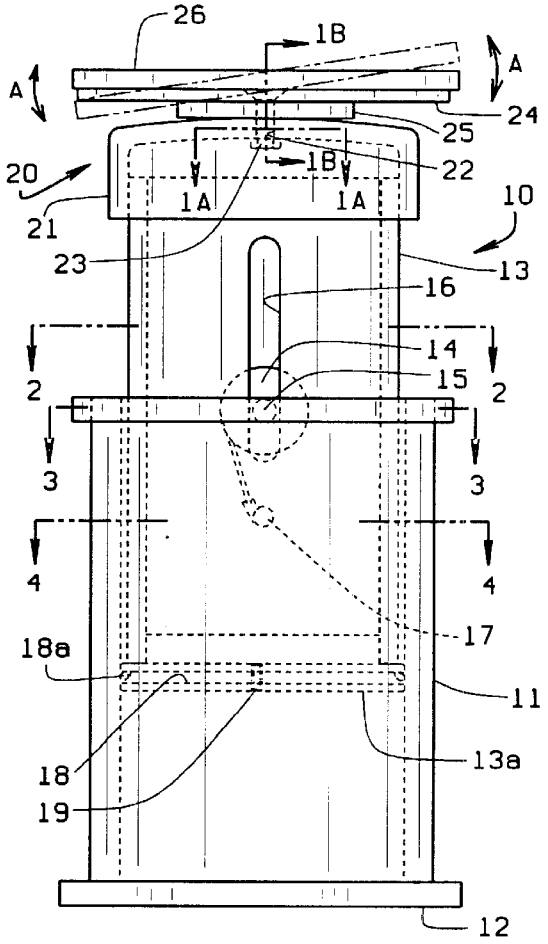
FIG. 1 is a side elevational view of a single constant restoring force piston.
Figure 1A:
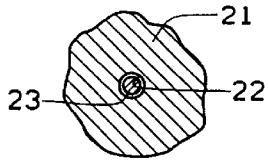
FIG. 1A is a fragmentary sectional view taken along line 1A—1A of FIG. 1.
Figure 1B:
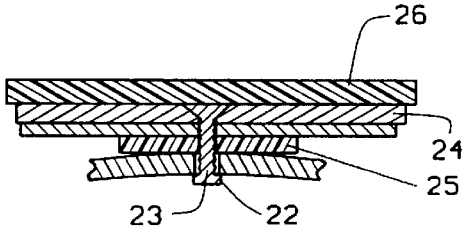
FIG. 1B is a fragmentary sectional view taken along line 1B—1B of FIG. 1.

The invention also consists in the parts and in the arrangements and combinations of parts hereinafter described and claimed.

DETAILED DESCRIPTION OF THE INVENTION

FIGS. 1–4 show a constant restoring force member or piston 10 which comprises a second tubular member 11 positioned on a base 12 and a first tubular member 13 slidable in and guided by the second tubular member 11. A constant restoring force return spring 14 interconnects the members 11 and 13. The spring 14 is mounted on a rod 15 which is anchored to the second tubular member 11 and slides through longitudinal slots 16 in the first tubular member 13. One end of the spring 14 is anchored to a rod 17 positioned in the first tubular member 13. The constant restoring force spring 14 can be any commercially available spring such as the SPEC® BRAND spring sold by ASSOCIATED SPRING RAYMOND BARNES GROUP of Cory, Pa. 16407. The characteristic of the spring 14 is that its rating determines the force necessary for relative movement between the cylinders 11 and 13 and the restoring force on the first member 13 is constant within its limits of travel regardless of the depth of its immersion in the second member 11.

The constant restoring force spring 14 is located inside the first member 13 to provide a force component that is acting along the centerline of the member 13 to minimize side loading which can cause friction between the member 13 and the member 11.

A preferred embodiment of the invention includes a bottom member 13*a* on the first tubular member 13. The bottom member 13*a* has a groove 18 in which is positioned an O-ring seal 18*a*. The seal 18*a* engages the inside wall 11 a of the second tubular member 11 and tends to prevent escape of air past it as the first tubular member 13 moves into the second tubular member 11. An opening 19 is located through the bottom member 13*a* to provide controlled escape of air past the bottom member 13*a* as the first member 13 moves into the; second member 11. This provides a damper on the rate of movement of the first member 13 and creates an effect similar to a controlled viscosity fluid. This provides a smooth controlled feel for the person sitting on the piston assembly.

Positioned on the free or outer end of the first cylinder 13 is a top structure 20 which includes a base cap 21 which can be frictionally mounted on the end of the first cylinder 13. The cap 21 has a central aperture 22 in which a rivet 23 (or a ball and socket joint) is loosely positioned. The rivet 23 is slidable and tiltable in the aperture 22. The outer end of the rivet 23 is fixed to a rigid disc 24. Thus, the disc 24 is tiltable with respect to the cap 21. A resilient compressible buffer 25 is positioned around the rivet 23 between the cap 21 and the bottom side of the disc 24, to act as a spring to align an unloaded disk. The combination of the rivet 23, the enlarged cap opening 22, and the resilient washer 25 allows the disc 24 to have a universal type movement with multiple degrees of freedom with respect to the tubular member 13 (indicated by the arrows A in FIG. 1).

Figure 1C:
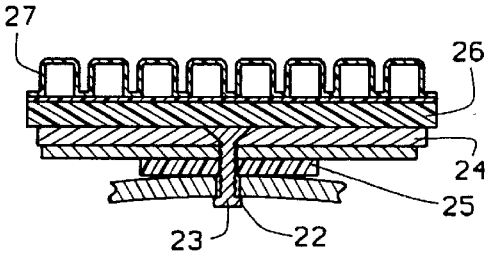
FIG. 1C is a view similar to FIG. 1B, but showing an air cell cushion topping the piston head.

As noted an alternative construction (useful in production embodiments) is a ball and socket arrangement. This is shown in FIG. 1E. The ball 35 is attached to a stem 36 which is fixed to the disc 24. A socket 37 is formed in the cap 21 to allow movement of the disc 24 with respect to the cap 21.

To enhance a soft surface feel, a foam top member 26 may be positioned on the outer surface of the disc 24.

If desired, a sealed cell or interconnected cell air-filled cushion 27 (FIG. 1C) can be positioned on top of the foam paid 26. The air-filled cellular cushion 27 also can be attached directly to the rigid disc 24 omitting the foam pad. These air cushions are shown in the aforementioned Graebe patents.

Figure 1D:
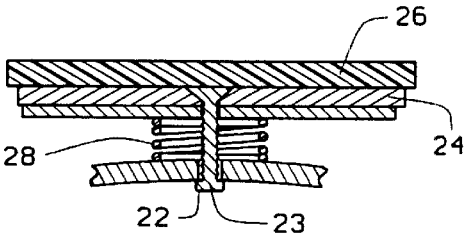
FIG. 1D is a view similar to FIG. 1B but showing a spring between the piston head and the cap.
Figure 1E:
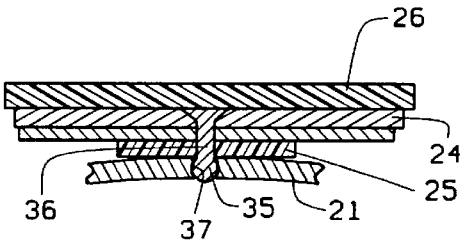
FIG. 1E is a view similar to FIG. 1B but showing a ball and socket connection between the piston head and cap.
Figure 2:
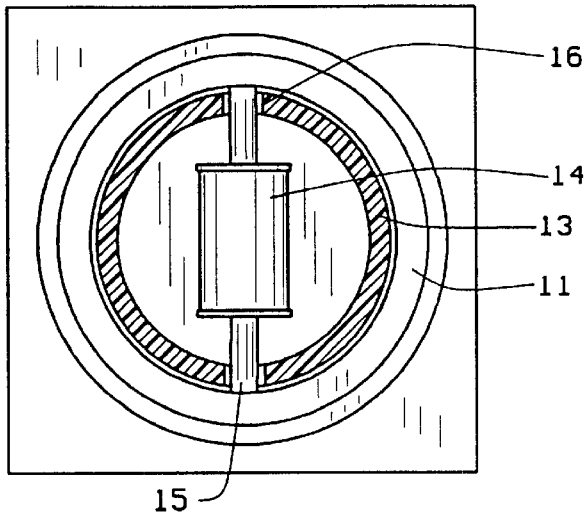
FIG. 2 is a sectional view taken along line 2—2 of FIG. 1.
Figure 3:
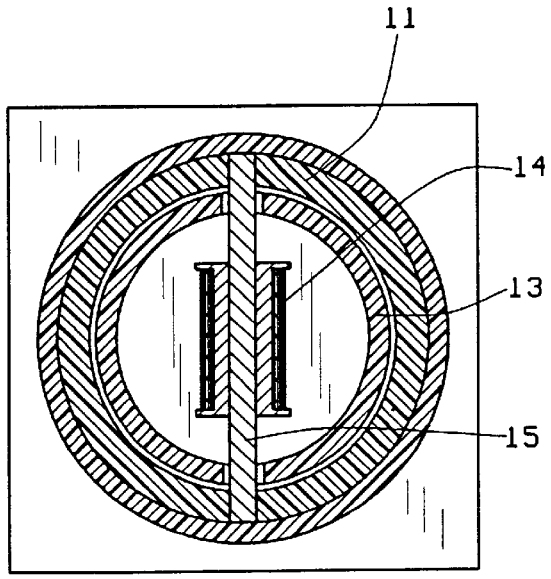
FIG. 3 is a sectional view taken along line 3—3 of FIG. 1.

FIG. 1D shows another modification in which a coil spring 28 is used in place of the compressible buffer 25.

When considering the effect moderate external forces have on the soft tissues of the body, when applied for extended periods of time, two things may happen. If the forces induce a shape change, deformation, the flow of blood in those affected tissues will be reduced. This reduction, known as ischemia, can create pain and if the reduction is enough for a long enough time the local tissue cells will die, a condition called necrosis.

These external forces also compress those tissues and will force the local fluids to move elsewhere in the body. This condition only occurs when a portion of the tissues are involved. When a person is totally immersed in a fluid and all of that person's tissues are being effected equally, excess fluids stay uniformly distributed or may exit the body as urine.

Figure 5:
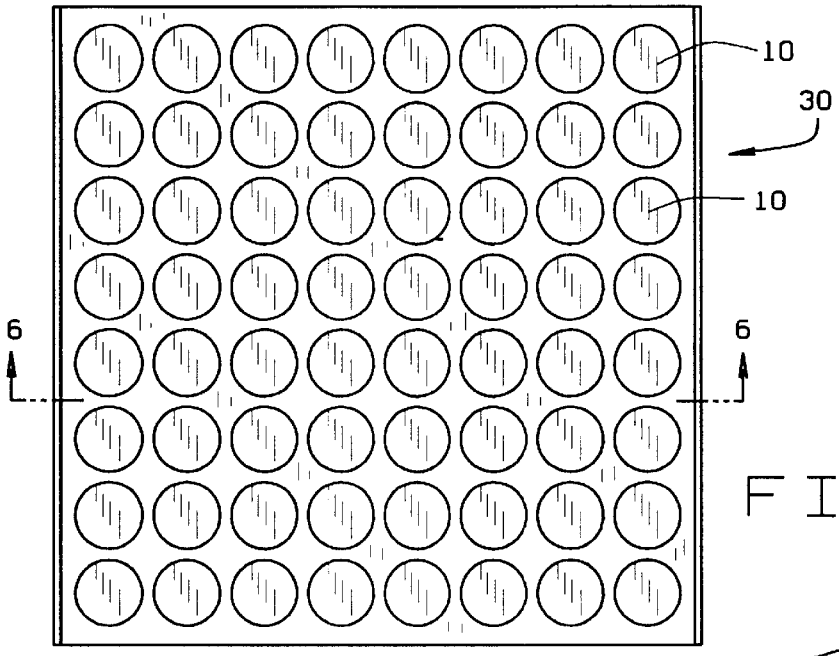
FIG. 5 is a top plan view of an array of pistons formed into a support surface.
Figure 5A:
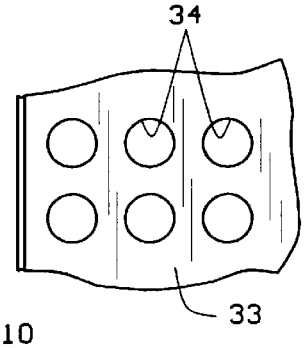
FIG. 5A is a fragmentary plan view of a portion of the top member of the support surface of FIG. 5.
Figure 6:
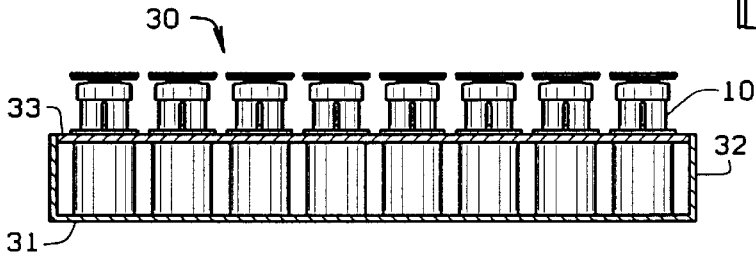
FIG. 6 is a vertical sectional view taken along line 6—6 of FIG. 5.
Figure 6A:
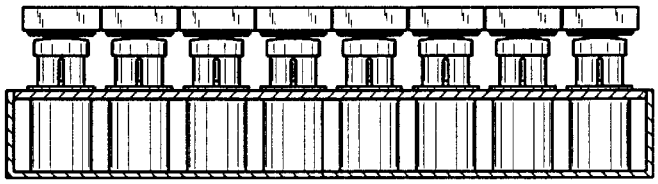
FIG. 6A is an end elevational view of a modification of the invention.

FIGS. 5 & 6 show an array of the pistons 10 assembled to define a support surface 30. The plurality of pistons 10 sitting on the surface 30 act to buoy up a person and minimize changing the person's shape. Depending on the weight of the person and the number of pistons, a spring force can be determined which will literally float the person without having the person touch bottom (or 'bottom out') which would induce high forces in a concentrated area to cause deformation of the soft tissues and ischemia. Bottoming out occurs when one or more of the pistons reaches its maximum length of travel or the second member 13 is moved as far as it can go into the first member 11.

The support surface 30 comprises a base member 31, side and end members 32 and a top member 33 which is provided with a plurality of openings 34 (FIG. SA) located in a predetermined arrangement to accommodate the pistons 10.

Since there is a need to accommodate various body weights and contact areas a means to adjust this assembly is desirable. To adjust this type of support surface 30, the spring force can be changed, the density of pistons changed or the travel deflection distance of the second piston member 13 changed. To facilitate adjustment of the surface 30 shown in FIG. 5, pistons 10 in the support base are removable which allows an individual piston assembly 10 to be easily inserted in the openings 34. Cell density is controlled by the design of the openings 34. Spring force levels are a function of the design of the spring 14. However, several springs 14 can be layered together to increase the total level of force. The location of the drum type of spring inside a tube limits how small a piston 10 can be constructed. When the spring or several springs are placed outside the piston, ignoring the risk of friction from side loads, a smaller sized piston and constant restoring force spring can be used and therefore a higher density of pistons can be used to construct a high density support surface as illustrated in FIGS. 7 and 8.

Figure 7:
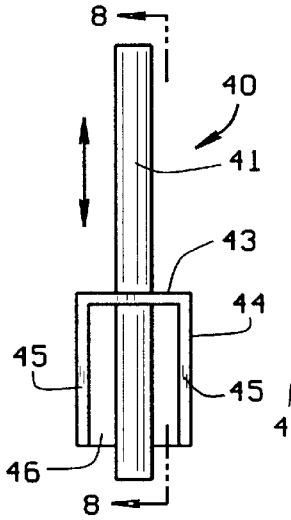
FIG. 7 is an end elevational view of another modification of the invention.
Figure 8:
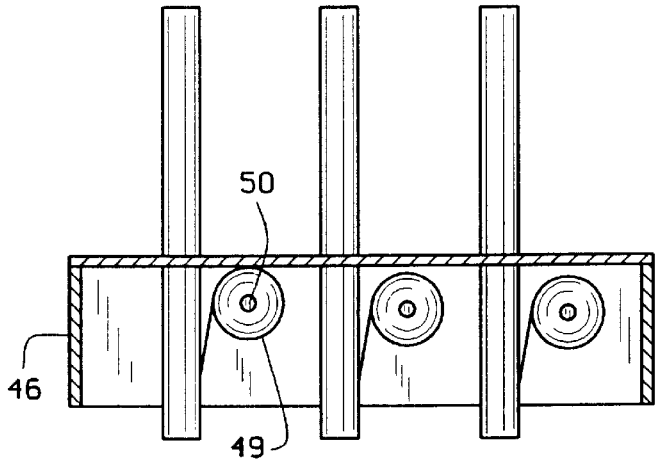
FIG. 8 is a vertical sectional view taken along line 8—8 of FIG. 7.
Figure 8A:
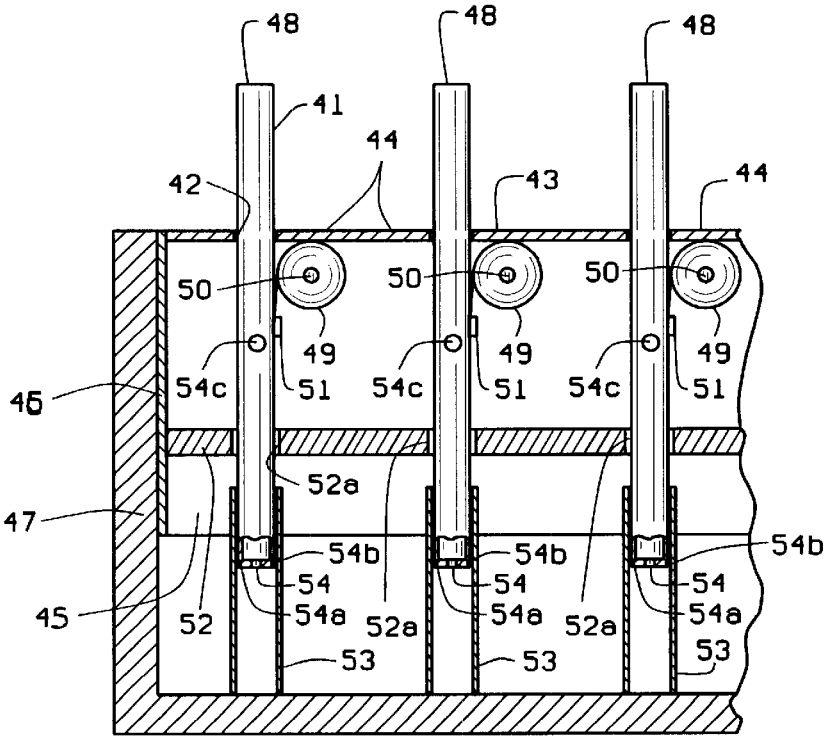
FIG. 8A is a fragmentary vertical sectional view of a modification of the invention.

In the arrangement shown in FIGS. 7–8A, each restoring force member 40 comprises a singular rod 41 (preferably hollow) positioned and slidable in an opening 42 formed in a connecting horizontal member 43 of an inverted U-shaped bracket 44. The bracket 44 includes spaced vertical legs 45 connected by the horizontal member 43 and end members 46 for installing the bracket 44 in a base 47 to form a composite support surface. A series of the brackets 44 are positioned in the base 47 to form the desired support surface 48 from the ends of the rods 41. Constant restoring force springs 49 are anchored to the legs 45 by pins 50 and to the rods 41 at 51. An additional bearing member 52 having openings 52*a* to stabilize the lower end of the slidable rod 41 may be employed and is illustrated in FIG. 8A. The arrangement provides space and purchase points to add a separate dashpot to control the velocity rate of the slidable rod. This too is shown in FIG. 8A and is similar to the configuration shown in FIG. 1. In this form, a cylinder 53 is aligned with and holds the hollow rod 41. The lower end of the rod 41 has an opening 54 and an annular groove 54*a* which holds an O-ring seal 54*b*. The air in the cylinder 53 escapes slowly through the opening 54 and a second opening 54*c* in the rod 41 to dampen and control movement of the rod 41. The arrangement of FIG. 8A can be modified to use only the cylinders 53 and not the bearing 52 or it may only use the bearing 52 and not the cylinder 53.

Figure 4:
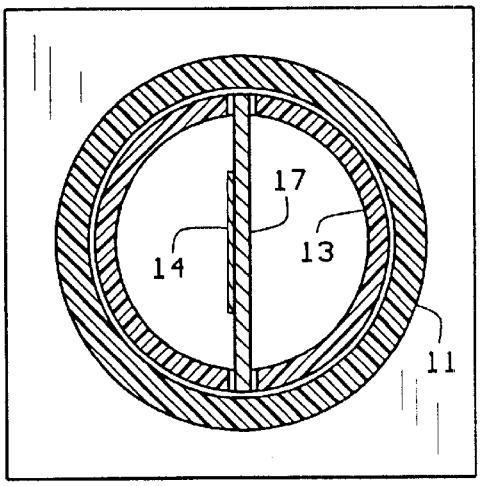
FIG. 4 is a sectional view taken along line 4—4 of FIG. 1.
Figure 6B:
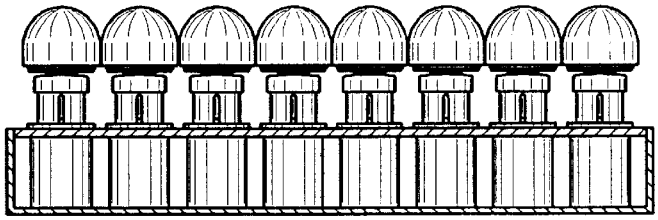
FIG. 6B is an end elevational view of another modification of the invention.
Figure 6C:
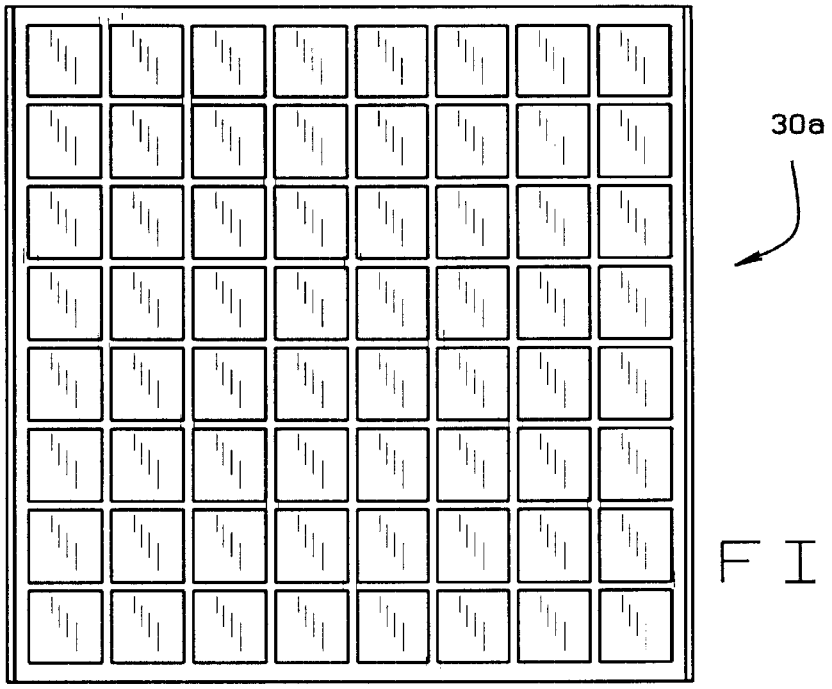
FIG. 6C is a top plan view of another modification of the invention.

To provide multiple degrees of freedom at the top of the piston several mechanical arrangements can be supplied. In FIG. 1, a tilting plate with a thin foam top 26 is shown. The foam top 26 is not required and the disc 24 can be used alone. In FIG. 1C, an air cell cushion is shown. In FIG. 4, a foam cylinder with a flat top is shown. FIG. 6B shows a domed top. FIG. 6C shows a square top surface 30*a*.

Figure 9:
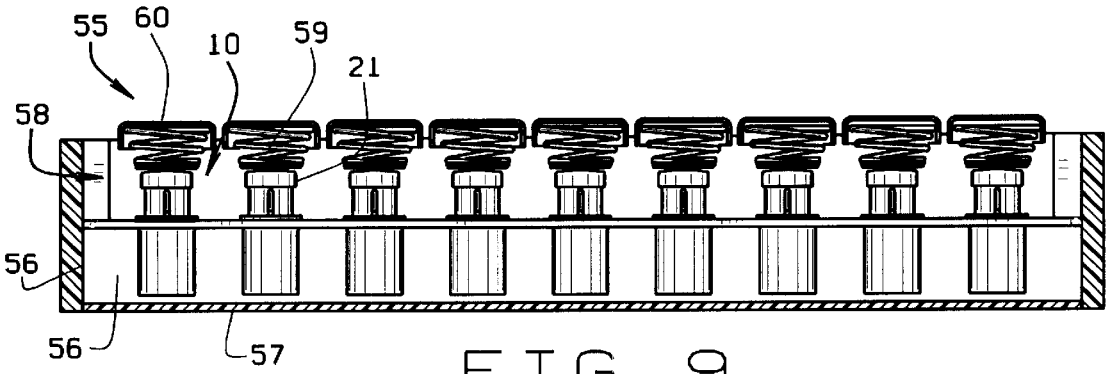
FIG. 9 is a vertical sectional view of another modification of the invention.

FIG. 9 shows a further embodiment in which a coil spring tissue interface is shown. The assembly 55 shown in FIG. 9 includes a housing having side and end walls 56 and a floor 57. Inside the housing is a bracket 58 which supports the pistons 10. On the caps 21 of each piston 10 are coil springs 59.

Since it is desirable to have the top of these pistons close together to create a reasonably continuous surface, mechanical interference can occur. This interference acts as a friction component of force and causes the constant restoring force to become not constant and this condition needs to be avoided. When using coil springs 59 on the cap 21, retainers 60 which extend below the top coils of the coil springs 59 are dropped over each spring 59 to prevent the coils from inter locking. The retainer 60 is fabricated from rigid plastic and has a highly slippery low friction surface.

Figure 9A:
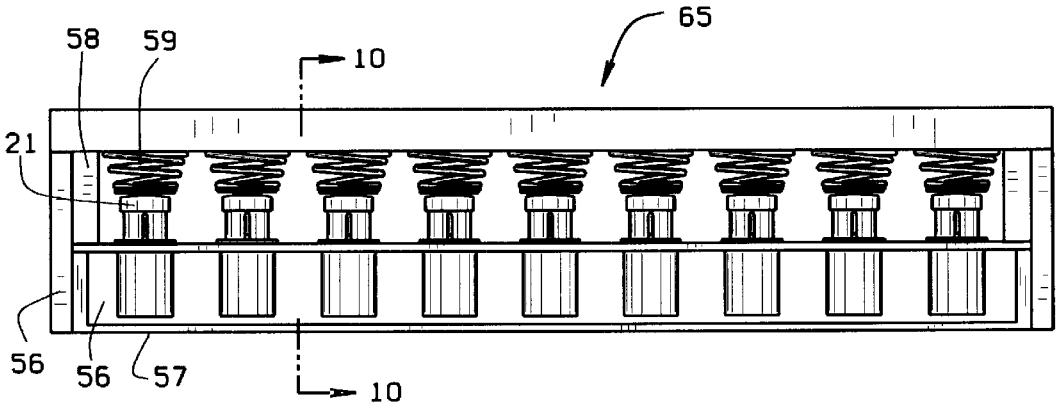
FIG. 9A is a vertical sectional view of another modification of the invention.
Figure 10:
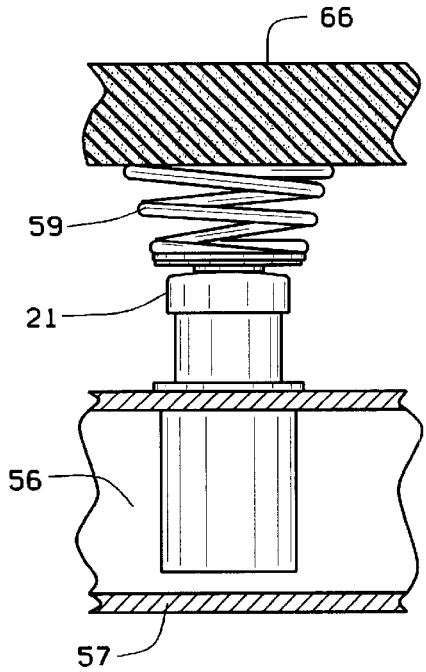
FIG. 10 is a fragmentary sectional view taken along line 10—10 of FIG. 9A.

FIGS. 9A & 10 show still another modification of the cushion 65. In this arrangement piston density is reduced to increase the distance between the tops of the pistons. To present a smooth surface to the person being supported, a pad 66 is placed on top of the pistons 10. The addition of any interface padding on top of a displaceable surface reduces its capability to assume the shape of the person being supported. However, this compromise is acceptable when comfort is the objective. The pad 66 can be expanded foam or any other suitable material.

The arrangement of FIGS. 9A & 10 is shown with coil springs 59 interposed between the pad 66 and the caps 21, but any of the illustrated tops can be used with a pad 66. For example, a pad 66 can be placed over an array of discs 24.

Figure 10A:
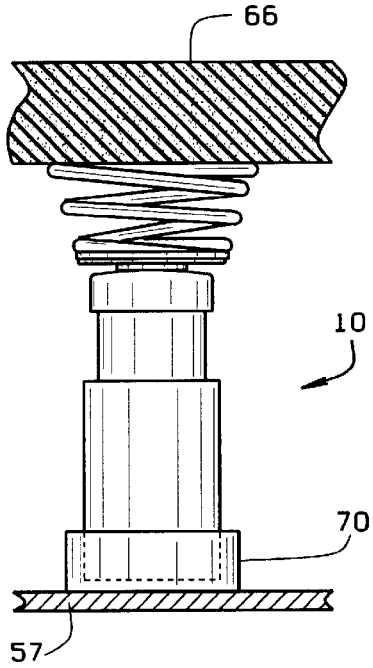
FIG. 10A is a fragmentary view partly in section showing a modification of the invention.
Figure 11:
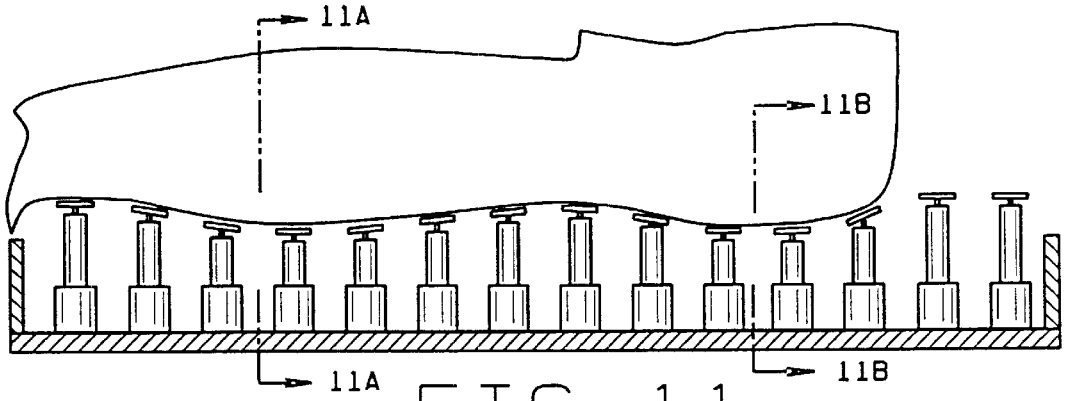
FIG. 11 is a fragmentary diagrammatic side view showing a person sitting on a cushion of this invention.
Figure 11A:
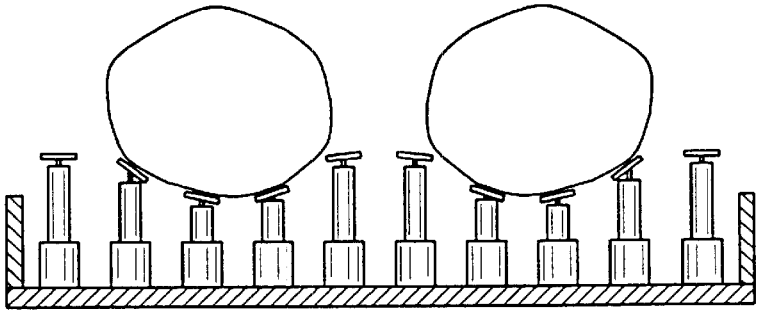
FIG. 11A is a view similar to FIG. 11 taken along line 11A—11A of FIG. 11.
Figure 11B:
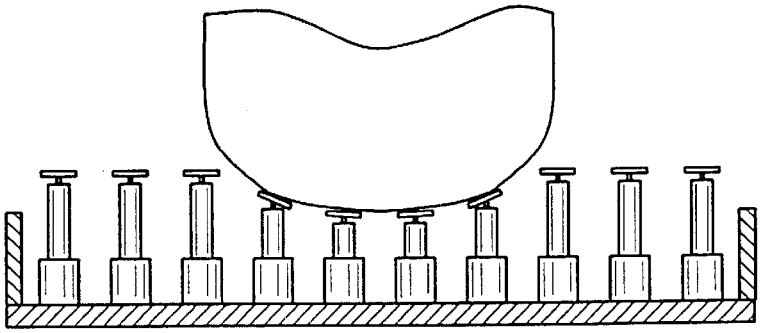
FIG. 11B is a view similar to FIG. 11 taken along line 11B—11B of FIG. 11.
Figure 12:
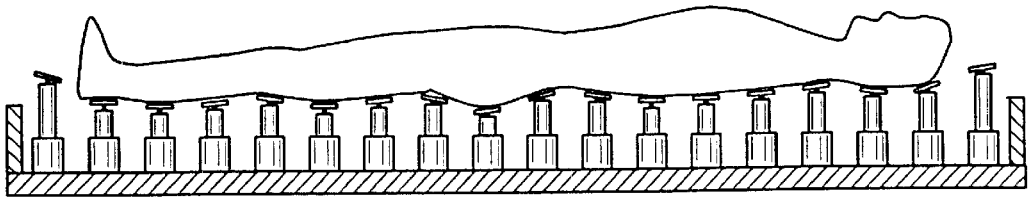
FIG. 12 is a fragmentary diagrammatic side view showing a person lying on a mattress of this invention.

FIG. 10A shows another modification of the present invention in which a socket 70 is mounted on the housing floor 57 and the piston 10 is set in the socket 70.

FIGS. 11, 11A, 11B & 12 show diagrammatic representations of the deflection of the pistons 10 and the relative positions of the disc 24 and any interface member attached thereto when a person is seated or is lying on the cushion or mattress embodying this invention.

Thus it is seen that the present invention achieves all of the objects and advantages sought therefor and this invention is intended to cover all changes and modifications of the example of the invention herein chosen for purposes of the disclosure which do not constitute departures from the spirit and scope of the invention.

| Parts List | |
|---|---|
| 10 | restoring force member or piston |
| 11 | second tubular member |
| 12 | base |
| 13 | first tubular member |
| 13a | base of 13 |
| 14 | constant restoring force spring |
| 15 | rod |
| 16 | slots |
| 17 | rod |
| 18 | groove in 13a |
| 18a | O-ring seal |
| 19 | opening through 13a |
| 20 | top structure |
| 21 | cap |
| 22 | hole in cap |
| 23 | rivet |
| 24 | disc |
| 25 | buffer |
| 26 | foam top |
| 27 | air cell cushion |
| 28 | coil spring |
| 29 | |
| 30 | support surface |
| 30a | square top |
| 31 | base member |
| 32 | side and end members |
| 33 | top member |
| 34 | openings |
| 35 | ball |
| 36 | stem |
| 37 | socket |
| 38 | |
| 39 | |
| 40 | restoring force member |
| 41 | rod |
| 42 | opening in 43 |
| 43 | horizontal member |
| 44 | U-shaped bracket |
| 45 | legs |
| 46 | end member |
| 47 | base |
| 48 | support surface |
| 49 | CF spring |
| 50 | pin |
| 51 | anchor point |
| 52 | bearing opening |
| 53 | cylinder |
| 54 | opening |
| 54a | groove |
| 54b | o-ring |
| 54c | second opening |
| 55 | assembly |
| 56 | side & end walls of housing |
| 57 | floor |
| 58 | bracket |
| 59 | coil spring |
| 60 | retainer |
| 61 | |
| 62 | |
| 63 | |
| 64 | |
| 65 | cushion |
| 66 | foam top |
| 67 | |
| 68 | |
| 69 | |
| 70 | socket |

What is claimed is:

1. A constant restoring force structure comprising a first tubular member positioned on a base, a second tubular member slidable in said first tubular member and guided by said first tubular member, and a constant restoring force spring interconnecting said first and second tubular members, said second tubular member having an extended position whereby it is projecting outwardly of said first tubular member and a retracted position whereby it is recessed in said first tubular member, said second tubular member being responsive to a force exerted on its outward end to move into said first tubular member when said force exceeds the rating of said constant force restoring spring, the restoring force on the second tubular member urging it outwardly of the first tubular member being constant regardless of its position in the first tubular member after its first move into said first tubular member.

2. The structure of claim 1 including a socket mounted on the base, and the first tubular element is engaged in said socket.

3. The structure of claim 1 wherein said second tubular member has a pivotable tiltable top to align to the surface area of a force exerted on it.

4. The structure of claim 1 wherein said constant restoring force spring is positioned inside said second member.

5. The structure of claim 1 including bases on the first and second tubular members, the base of second tubular member having an opening therethrough and a peripheral seal whereby air trapped in the first tubular member is forced through the opening to dampen movement of the second member into said first member.

6. A cushion or mattress assembly comprising a support structure having a base, side and end walls, and a plurality of the constant restoring force spring elements defmed in claim 1 positioned adjacent to each other inside said support structure whereby the outward ends of the second tubular members define a substantially continuous support surface and the strength of the constant restoring force springs are selected to support the weight of a person positioned on the cushion or mattress assembly without any of the second tubular members of the constant restoring force return spring assemblies engaging the base.

7. The cushion or mattress of claim 6 wherein the ends of the second tubular members are pivotable and tiltable to conform to the shape of the portion of the anatomy of the person utilizing said cushion or mattress.

8. The cushion or mattress of claim 6 wherein the constant restoring force spring members are replaceably positioned in said support structure.

9. The cushion or mattress of claim 8 including coil springs on the tops of the second tubular elements to provide multiple degrees of freedom to the top surface.

10. The cushion or mattress of claim 9 including retainer caps on the tops of the springs to reduce interference between adjacent springs.

11. The cushion or mattress of claim 10 wherein the top surfaces of the caps are highly slippery with a low coefficient of friction.

12. The cushion or mattress of claim 6 including sockets on the base, the first tubular members being engaged in said sockets to locate and position the constant force restoring structures in a predetermined arrangement.

13. The cushion or mattress of claim 8 wherein at least some of the second tubular members are provided with openings therethrough and peripheral seals to allow air trapped in the associated first tubular members to pass through at a controlled rate to dampen movement of the second tubular element.

14. A cushion or mattress assembly comprising a series of longitudinal support structures each including a side wall and a top wall, the top wall having openings therein, reciprocal members positioned in said openings, constant restoring force return springs anchored to said side wall adjacent to a reciprocal member and connected to said adjacent reciprocal member, the support structures being positioned side by side to define the length and breadth of said cushion or mattress.

15. The assembly of claim 14 including second support panels positioned inside the support structures and spaced downwardly form the top walls with openings aligned with the top wall openings and sized to slidably accommodate the reciprocal members to stabilize the lower ends thereof.

16. The cushion or mattress of claim 15 including a foam pad bridging the tops of a plurality of the constant restoring force return spring elements.

17. The cushion of claim 15 wherein the reciprocal members are hollow and cylindrical and have closed ends, the bottom ends having an opening therethrough, a second series of cylindrical members aligned with the reciprocal members and adapted to receive the reciprocal members, peripheral seals between the reciprocal members and the cylindrical members whereby air trapped in the cylindrical members passes through the bottom end openings at a controlled rate to dampen movement of the reciprocal members.

18. The cushion or mattress assembly of claim 14 wherein the support structures are an inverted U-shape.

19. The cushion or mattress of claim 14 wherein the reciprocal members are hollow and cylindrical and have closed ends, the bottom ends having an opening therethrough, a second series of cylindrical members aligned with the reciprocal members and adapted to receive the reciprocal members, peripheral seals between the reciprocal members and the cylindrical members whereby air trapped in the cylindrical members passes through the bottom end openings at a controlled rate to dampen movement of the reciprocal members.

20. A constant restoring force structure comprising a first tubular member positioned on a base, a second tubular member slidable in said first tubular member and guided by said first tubular member, and a constant restoring force spring interconnecting said first and second tubular members, said second tubular member having an extended position whereby it is projecting outwardly of said first tubular member and a retracted position whereby it is recessed in said first tubular member, said second tubular member being responsive to a force exerted on its outward end to move into said first tubular member when said force exceeds the rating of said constant force restoring spring, said second tubular member having a pivotable tiltable top to align to the surface area of a force exerted on it.

21. The structure of claim 20 wherein said second member has a composite top, said top comprising a rigid element connected to said second member and a foam element fastened to the outer surface of said rigid element.

22. The structure of claim 21 wherein said second member has a top which is square.

23. The structure of claim 20 wherein said second member has a top which is domed.

24. The structure of claim 20 wherein said second member has a top which is circular.

25. The structure of claim 20 wherein said second member has a composite top, said top having a rigid element connected to said second member and an air cell pad extending outwardly from the rigid element.

26. The structure of claim 20 wherein said second member is provided with a longitudinal slot, a pin positioned in said slot and fixed to the side walls of the first member, and said constant restoring force spring is fastened at one end to said pin and at its other end to the inside of said second member, the pin being movable in the slot as the second member is telescoped inside of said first member.

27. The structure of claim 26 including a cap on the outward end of the second member, a substantial central opening in said cap, a pivotable tiltable composite pad on the top of the cap, the composite pad comprising foam pads sandwiched around a rigid disc, and a retaining member whereby the disc is free to pivot, rotate and tilt with respect to the cap and the second member.

28. The structure of claim 20 including a coil spring positioned between the pivotable top and the second member.

29. The structure of claim 20 including a foam pad positioned between the pivotable top and the second member.

30. The structure of claim 20 wherein the top is connected to the second tubular member by a ball and socket assembly.

31. A constant restoring force structure comprising a first tubular member positioned on a base, a second tubular member slidable in said first tubular member and guided by said first tubular member, and a constant restoring force spring interconnecting said first and second tubular members, said second tubular member having an extended position whereby it is projecting outwardly of said first tubular member and a retracted position whereby it is recessed in said first tubular member, said second tubular member being responsive to a force exerted on its outward end to move into said first tubular member when said force exceeds the rating of said constant force restoring spring, said constant restoring force spring being positioned inside said second member.

32. A constant restoring force structure comprising a first tubular member positioned on a base, a second tubular member slidable in said first tubular member and guided by said first tubular member, and a constant restoring force spring interconnecting said first and second tubular members, said second tubular member having an extended position whereby it is projecting outwardly of said first tubular member and a retracted position whereby it is recessed in said first tubular member, said second tubular member being responsive to a force exerted on its outward end to move into said first tubular member when said force exceeds the rating of said constant force restoring spring, said bases on the first and second tubular members, the base of said second tubular member having an opening therethough and a peripheral seal whereby air trapped in said first tubular member is forced through the opening to dampen movement of the second member into the first member.

33. A cushion or mattress assembly comprising a support structure having a base, side and end walls, and a plurality of constant restoring force spring elements positioned adjacent to each other inside said support structure and each comprises a first tubular member positioned on said base, a second tubular member slidable in said first tubular member and guided by said first tubular member, and a constant restoring force spring interconnecting said first and second tubular members, said second tubular member having an extended position whereby it is projecting outwardly of said first tubular member and a retracted position whereby it is recessed in said first tubular member, said second tubular member being responsive to a force exerted on its outward end to move into said first tubular member when said force exceeds the rating of said constant force restoring spring, whereby the outward ends of the second tubular elements define a substantially continuous support surface and the strength of the constant restoring force springs are selected to support the weight of a person positioned on the cushion or mattress assembly without any of the second tubular members of the constant restoring force return spring assemblies engaging the base, the ends of the tubular members being pivotable and tiltable to conform to the shape of the portion of the anatomy of the person utilizing said cushion or mattress.

34. The cushion or mattress of claim 33 wherein foam blocks are positioned on the ends of the second tubular members.

35. The cushion or mattress of claim 33 wherein the ends of the second tubular members are connected to the second tubular members by ball and socket connections.

36. A cushion or mattress assembly comprising a support structure having a base, side and end walls, and a plurality of constant restoring force spring elements positioned adjacent to each other inside said support structure and each comprises a first tubular member positioned on said base, a second tubular member slidable in said first tubular member and guided by said first tubular member, and a constant restoring force spring interconnecting said first and second tubular members, said second tubular member having an extended position whereby it is projecting outwardly of said first tubular member and a retracted position whereby it is recessed in said first tubular member, said second tubular member being responsive to a force exerted on its outward end to move into said first tubular member when said force exceeds the rating of said constant force restoring spring, whereby the outward ends of the second tubular elements define a substantially continuous support surface and the strength of the constant restoring force springs are selected to support the weight of a person positioned on the cushion or mattress assembly without any of the second tubular members of the constant restoring force return spring assemblies engaging the base, the constant restoring force spring elements being replaceably positioned in said support structure.

37. A cushion or mattress assembly comprising a support structure having a base, side and end walls, and a plurality of constant restoring force spring elements positioned adjacent to each other inside said support structure and each comprises a first tubular member positioned on said base, a second tubular member slidable in said first tubular member and guided by said first tubular member, and a constant restoring force spring interconnecting said first and second tubular members, said second tubular member having an extended position whereby it is projecting outwardly of said first tubular member and a retracted position whereby it is recessed in said first tubular member, said second tubular member being responsive to a force exerted on its outward end to move into said first tubular member when said force exceeds the rating of said constant force restoring spring, whereby the outward ends of the second tubular elements define a substantially continuous support surface and the strength of the constant restoring force springs are selected to support the weight of a person positioned on the cushion or mattress assembly without any of the second tubular members of the constant restoring force return spring assemblies engaging the base, and sockets on the base, said first tubular members being engaged in said sockets to locate and position the constant restoring force structures in a predetermined arrangement.

38. A cushion or mattress assembly comprising a support structure having a base, side and end walls, and a plurality of constant restoring force spring elements positioned adjacent to each other inside said support structure and each comprises a first tubular member positioned on said base, a second tubular member slidable in said first tubular member and guided by said first tubular member, and a constant restoring force spring interconnecting said first and second tubular members, said second tubular member having an extended position whereby it is projecting outwardly of said first tubular member and a retracted position whereby it is recessed in said first tubular member, said second tubular member being responsive to a force exerted on its outward end to move into said first tubular member when said force exceeds the rating of said constant force restoring spring, whereby the outward ends of the second tubular elements define a substantially continuous support surface and the strength of the constant restoring force springs are selected to support the weight of a person positioned on the cushion or mattress assembly without any of the second tubular members of the constant restoring force return spring assemblies engaging the base, at least some of the second tubular members being provided with openings therethrough and having peripheral seals to allow air trapped in the associated first tubular members to pass through at a controlled rate to dampen movement of the second tubular members.

* * * * *